United States Patent [19]

Shin

[11] Patent Number: 4,648,548

[45] Date of Patent: Mar. 10, 1987

[54] BOX WITH REMOVABLE DECORATIVE FIGURES

[76] Inventor: Sang J. Shin, 265 Sangdo 4-Dong, Dongjak-ku, Seoul, Rep. of Korea

[21] Appl. No.: 793,749

[22] Filed: Nov. 1, 1985

[51] Int. Cl.[4] ..... B65D 5/00

[52] U.S. Cl. ..... 229/8; 40/312; 206/459; 229/52 B; 446/901

[58] Field of Search ..... 229/8, 52 B; 206/459, 206/591, 594, 457; 40/312; 446/901, 98, 99; 428/40; 273/287

[56] References Cited

U.S. PATENT DOCUMENTS

| | | | |
|---|---|---|---|
| 720,876 | 2/1903 | Atherton | 446/901 |
| 1,601,373 | 9/1926 | Honti | 446/98 |
| 2,293,887 | 8/1942 | Chamberlain | 446/901 |
| 2,711,541 | 6/1955 | Bellett | 229/8 |
| 2,731,766 | 1/1956 | Rubin | 446/99 |
| 2,959,337 | 11/1960 | Crave, Jr. | 229/52 B |
| 3,100,642 | 8/1963 | Goldstein | 273/287 |
| 3,207,411 | 9/1965 | Farquhar | 206/459 |
| 3,267,623 | 8/1966 | Block | 428/40 |
| 3,440,747 | 4/1969 | Oliver | 40/312 |
| 3,695,514 | 10/1972 | Mascetti, Jr. | 206/459 |
| 4,084,015 | 4/1978 | Patterson | 229/8 |
| 4,336,664 | 6/1982 | Penick et al. | 40/312 |
| 4,345,393 | 8/1982 | Price et al. | 40/312 |
| 4,560,562 | 12/1985 | Schroeder | 206/459 |

FOREIGN PATENT DOCUMENTS

| | | | |
|---|---|---|---|
| 2950389 | 7/1980 | Fed. Rep. of Germany | 229/8 |
| 1047592 | 7/1953 | France | 229/8 |
| 406051 | 9/1966 | Switzerland | 229/8 |
| 451811 | 8/1936 | United Kingdom | 40/312 |
| 653777 | 5/1951 | United Kingdom | 229/8 |

*Primary Examiner*—William Price
*Assistant Examiner*—Gary E. Elkins
*Attorney, Agent, or Firm*—Birch, Stewart, Kolasch & Birch

[57] ABSTRACT

The present invention defines a container which is provided with a plurality of decorative figures defined by cut lines or perforations disposed in the surfaces of the container. After the container is no longer functioning as a container, the decorative figures disposed in the walls thereof can be either cut or punched from the container walls and used for a variety of purposes.

4 Claims, 5 Drawing Figures

BOX WITH REMOVABLE DECORATIVE FIGURES

BACKGROUND OF THE INVENTION

The present invention relates to a box or container having decorative figures disposed in the walls of the container. The decorative figures are defined by perforations which facilitate the punching out of the decorative figures for use as toys, Christmas ornaments, and the like. Insert boards are adapted to be disposed in the containers to act as a buffer between articles present in the container. The insert boards have the same construction as the walls of the container and, accordingly, contain a number of decorative figures which can be cut or punched from the board and used by children once the contents of the container have been used.

It is common to provide the surface of a container with decorative figures, printed matter, and the like, illustrating, by way of advertisement, the contents of the box. However, once the contents of the box is utilized, tne box is generally thrown away, leading to waste and disposal problems. According to the present invention, a container construction is provided whereby when the contents of the container is utilized, the walls of the container, which contain decorative figures, can be further utilized by children as toys, decorative items and/or learning-type vehicles.

OBJECTS AND SUMMARY OF THE INVENTION

It is an object of the present invention to provide a container having a paper board construction wherein the walls of said container are provided with decorative figures defined by perforations disposed in the surfaces of the container walls.

Another object of the present invention is to provide paper board inserts which can be disposed within the container to act as a buffer for articles disposed in the container, said paper board inserts also having decorative figures defined by perforations disposed in the surfaces of the paper board inserts.

A further object of the present invention is to provide an adhesive transparent sheet which is attached to the inside surface of the walls of the container as well as the inside surface of the insert paper boards.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
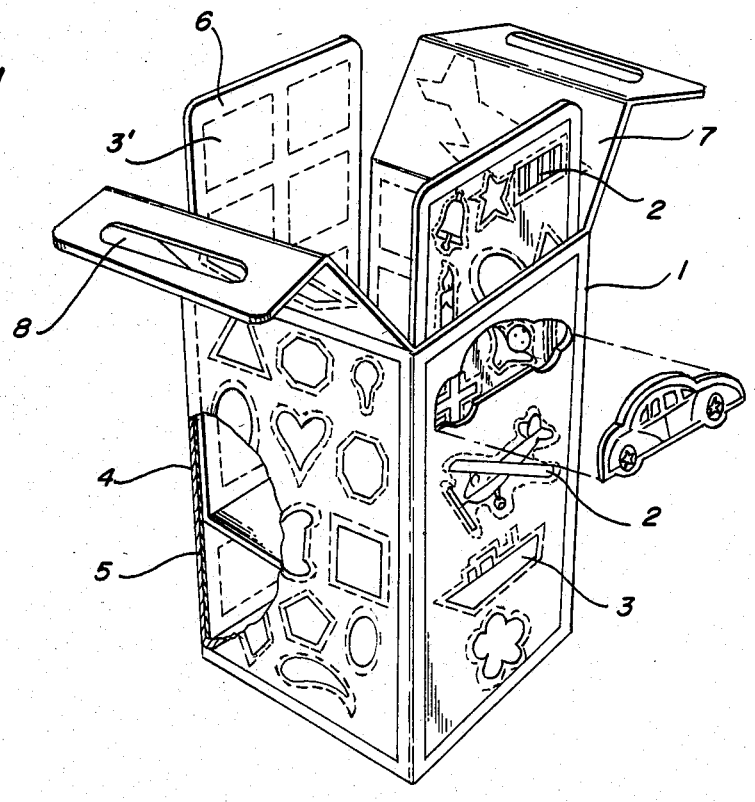
FIG. 1 is a perspective view of a container of the present invention.
Figure 2:
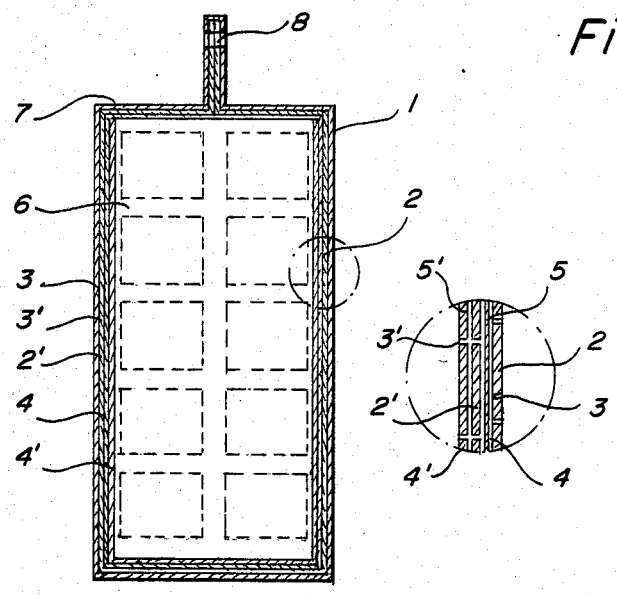
FIG. 2 is a view of the container of the present invention, viewed from within.
Figure 3:
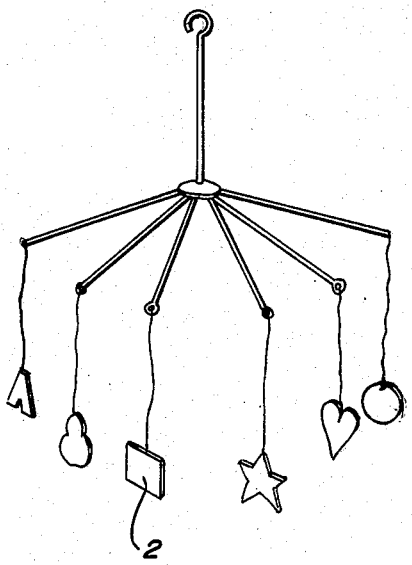
FIG. 3 is a perspective view of a decorative swing which utilizes the decorative figures cut from the container of the present invention.
Figure 4:
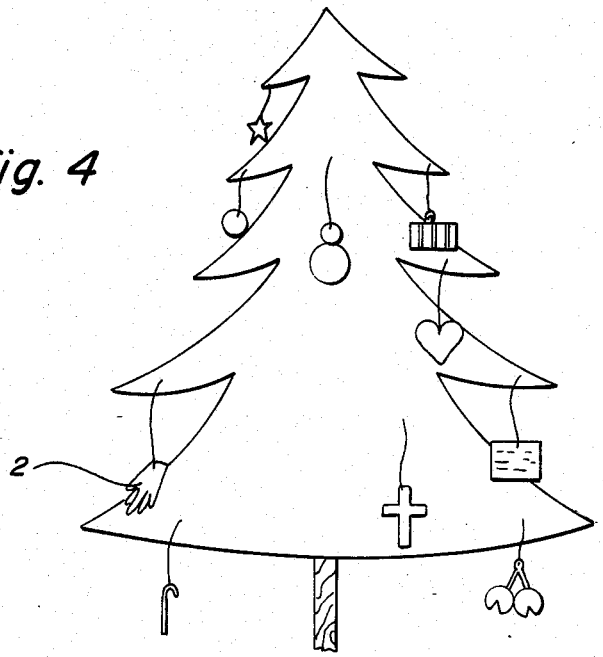
FIG. 4 is a diagrammatic view of a Christmas tree decorated with decorative figures cut from the container of the present invention.
Figure 5:
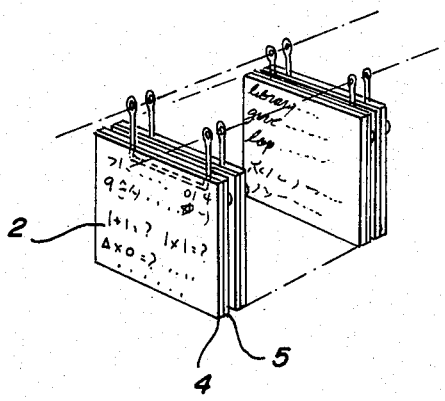
FIG. 5 is a view of lesson cards and cards containing various types of information which are provided with an overlay protective transparent sheet taken from the inside surface of the container walls of the present invention.

Referring now in detail to the drawings for purposes of illustrating the present invention, the container 1 of FIGS. 1 and 2 comprises walls which contain decorative figures, letters, and the like which can be cut from the container along perforated cutting lines 3. An adhesive sheet material such as a plastic sheet material 5 which is coated with an adhesive material 4 is adhered to the inside surfaces of the walls of the container. An insert element 6 which can be made of paper board which is also provided with decorative figures defined by perforations are provided for insertion into the container in order to act as a buffer for protecting materials which are placed into the container from shock. As stated above, the paper board insert 6 also is adapted to contain decorative letters and/or Figures 2' which are defined by a perforated cutting line 3' and an adhesive sheet material 5' disposed on the backside of the paper board insert. The adhesive sheet material has a cutting line 3' with a specific configuration, for example, a square configuration and is adapted to adhere to the other side of the decorative figures and/or letters 2'. The container 1 is provided with an upper cover 7 and a handle forming part of the upper cover.

In operation, when the goods are purchased, the paper board inserts 6 are placed into the container 1 together with the purchased goods and the upper cover is closed so that the container can be carried by utilizing the handle 8. When the goods in the container are removed and the container is no longer desired, the container walls can now be used in accordance with the decorative material which is imprinted on the walls of the container and the paper board insert. Thus, the decorative figures can be cut around the cut line with a scissors with the adhesive sheet being maintained in place to provide backing support for the decorative figures. These decorative figures can thus be used as toys or ornaments to be hung on a Christmas tree or the like. If desired, the adhesive sheet can be removed after the decorative figures have been cut from the walls of the container, and the residual adhesive remaining on the back of the decorative features can be utilized as an adhesive for sticking the decorative figures on a surface such as, for example, a wall. On the other hand, if a scissors is not available, the adhesive sheet can be completely removed from the wall of the container and the decorative figures can be merely punched out from the wall along the cut line. In such a situation where the transparent adhesive sheet is removed from the back of the wall of the container, since the transparent sheet also has cut lines with a defined configuration, such as, for example, a square configuration, the square configuration can be removed and used as a transparent, protective overlay for protecting the surfaces of papers having educational material, for example, mathematical formulations, and the like, disposed on the surface thereof. Thus, for example, lesson cards containing educational material can be produced by students with the cards being coated on both sides with adhesive layers 4, 4'.

The carton of the present invention can be made of any stiff, cardboard-like construction and the transparent sheet material can be a plastic sheet of material, for example, a sheet of polyvinylchloride, polyethylene, polyteraphathylate, and the like. Any suitable adhesive can be applied to the transparent plastic sheet.

The invention being thus described, it will be obvious that the same may be varied in many ways. Such variations are not to be regarded as a departure from the spirit and scope of the invention, and all such modifications as would be obvious to one skilled in the are intended to be included within the scope of the following claims.

What is claimed is:

1. A container having a paper cardboard construction and paper board inserts therefor for protecting the container contents from mishandling and shock which comprises providing the walls of said container with decorative figures defined by perforations disposed in the surfaces thereof, an adhesive coated transparent plastic sheet adhered to the inside surface of said walls of the container, said adhesive coated plastic sheet provided with perforations corresponding to those of the decorative figures so that when the decorative figures containing the plastic sheet are removed from the container along said perforations, the decorative figures can be used as individual ornaments or the plastic sheet can be separated from the decorative figures leaving residual adhesive on said decorative figures for adherence to a surface, and said paper board inserts having the same construction and decorative figures as the walls of the container.

2. The container of claim 1, wherein the decorative figures are cut along the perforations in the walls of the container, said adhesive coated plastic sheet providing support to said figures.

3. The container of claim 1, wherein the adhesive coated plastic sheet is removed and the decorative figures are punched out from the walls of the container along said perforations of the walls.

4. The container of claim 1, wherein the container is provided with a handle which is an extension of the walls of the container.

* * * * *